United States Patent [19]

Yamamura et al.

[11] Patent Number: 4,991,348

[45] Date of Patent: Feb. 12, 1991

[54] POWER WINDOW APPARATUS

[75] Inventors: Kengo Yamamura, Shizuoka; Tsutomu Saito, Toyohashi, both of Japan

[73] Assignees: Asmo Co., Ltd., Shizuoka; Nippondenso Co., Ltd., Aichi, both of Japan

[21] Appl. No.: 417,466

[22] Filed: Oct. 5, 1989

[30] Foreign Application Priority Data

Jul. 31, 1989 [JP] Japan ..... 1-199062

[51] Int. Cl.[5] ..... E05F 15/08

[52] U.S. Cl. ..... 49/349; 49/358; 49/362

[58] Field of Search ..... 49/349, 362, 351, 350, 49/348, 358

[56] References Cited

U.S. PATENT DOCUMENTS

| | | | |
|---|---|---|---|
| 1,153,404 | 9/1915 | Rasmussen et al. | 49/362 X |
| 2,336,530 | 12/1943 | Chandler et al. | 49/349 |
| 2,947,569 | 8/1960 | McDougall | 49/349 X |
| 3,449,861 | 6/1969 | Lecomte | 49/358 X |
| 4,167,834 | 9/1979 | Pickles | 49/358 |
| 4,170,847 | 10/1979 | Pickles | 49/349 |
| 4,420,906 | 12/1983 | Pickles | 49/349 X |
| 4,575,967 | 3/1986 | Bickerstaff | 49/211 |
| 4,730,414 | 3/1988 | Nakamura et al. | 49/348 |

FOREIGN PATENT DOCUMENTS

| | | |
|---|---|---|
| 60-68284 | 5/1985 | Japan . |
| 61-286485 | 12/1986 | Japan . |

*Primary Examiner*—Philip C. Kannan

*Attorney, Agent, or Firm*—Venable, Baetjer & Howard

[57] ABSTRACT

A power window apparatus improved to reduce the step between the outer surface of a window glass and the outer surface of a door outer panel so as to realize a flush surface state when the window glass has been moved to full close position. The window glass is supported such that the lower end portion of the window glass can be moved towards the door outer panel and the lower end portion of the window glass is shifted towards the door outer panel when the window glass has been moved to a position near the full close position.

13 Claims, 9 Drawing Sheets

POWER WINDOW APPARATUS

BACKGROUND OF THE INVENTION

1. Field of the Invention

The present invention relates to a power window apparatus and, more particularly, to a power window apparatus having a rack and a pinion which rolls on the rack in meshing engagement therewith so as to move a window glass between open and close positions.

2. Description of the Related Art

A power window apparatus having a rack and a pinion for driving a window glass between open and close positions have been known from, for example, Japanese Utility Model Application Laid-Open No. 60-68284 and Japanese Patent Application Laid-Open No. 61-286485.

In this known power window apparatus, a rack is disposed in a space between the door outer and door inner panels so as to extend in the direction of movement of the window glass. A motor is fixed to the lower end of the window glass through a holder. The motor has an output shaft carrying a pinion which meshes with the above-mentioned rack, so that rotation of the motor output shaft in one and the other directions causes the pinion to roll along the rack so as to drive the window glass up and down between the open and close positions.

This type of power window apparatus offers advantages over so-called X-arm type power window apparatus in that the internal of a door between the door outer panel and inner panel is effectively be utilized by virtue of reduced number of parts and smaller space for installation of such parts.

Members such as reinforcers for the door outer panel, rods and arm members for locking and unlocking the door and so forth are disposed between the door outer panel and the window glass when the window glass has been retracted into the door.

In the known power window apparatus, components on the window glass such a rack, motor and so forth are disposed such that they do not interfere with the above-mentioned members such as reinforcers, rods and arms inside the door when the window is opened, i.e., when the window glass has been retracted into the space between both door panels. In addition, the path of movement of the window glass is so determined that the components on the window glass are not interfered with the above-mentioned members disposed between both door panels.

More specifically, in the known power window apparatus, components such as a rack, motor and so forth carried by the window glass, as well as window glass itself, are slightly spaced from the outer door panel towards the compartment. In addition, the window glass is curved in the thicknesswise direction of the door. Consequently, the path of movement of the window glass also is spaced away from the door outer panel inwardly of the compartment. This arrangement enables the window glass to be moved smoothly in the opening and closing directions without being interfered with other members.

In the known power window apparatus of the type described, a height difference or a step is inevitably formed between the outer surface of the window glass and the outer surface of the door outer panel, because the window glass and the components of the window driving mechanism carried by the window glass are spaced away from the door outer panel towards the compartment. Obviously, the step between the outer surface of the window glass and the outer surface of the door outer panel is preferably made small. In recent years, there is a demand for "flush surface", i.e., that the outer surfaces of the window glass and the outer door panel are substantially flush with each other when the window glass is in full close position.

As stated before, members such as reinforcers, rods and arms exist between the window glass and the door outer panel when the window is opened, i.e., when the window glass has been retracted into the space between the door outer and inner panels, so that it is impossible to locate the window glass in the vicinity of the door outer panel.

SUMMARY OF THE INVENTION

Accordingly, an object of the present invention is to provide a power window apparatus which reduces the height difference between the outer surfaces of the window glass and the outer door panel so as to realize a flush surface state when the window glass is in the full close position, without impairing the function of the known power window apparatus.

To this end, according to the present invention, there is provided a power window apparatus disposed in a space between a door inner panel and a door outer panel of a door and capable of moving a window glass so as to open and close the window of the door, comprising: driving means secured to the window glass and having a rotary shaft; a rack stationarily disposed so as to extend in the opening and closing directions of the window glass; a pinion drivingly connected to the rotary shaft and capable of rotating in meshing engagement with the rack; guide mean capable of guiding the pinion gear along the rack while maintaining the meshing engagement between the pinion and the rack; and shifting means for shifting at least the lower end portion of the window glass towards the door outer panel when the window glass has been moved to a position near the full close position.

In operation, the pinion rolls along the rack in meshing engagement therewith so that the window glass is moved in opening and closing directions. When the window glass has reached a position near the full close position, the shifting means operates so as to shift at least the lower end of the window glass towards the outer side of the automobile, i.e., towards the door outer panel, thereby realizing a flush surface state. Thus the present invention effectively reduces the height difference or step between the outer surfaces of the door outer panel and the window glass, thereby providing flush surface of the window section.

In one form of the present invention, the rack is curved towards the outer side of the vehicle at a portion where the pinion rolls when the window glass has been moved near to the full close position. In consequence, the pinion gear rolling along the rack is forced to move outwardly of the vehicle towards the outer panel when the window glass has been moved to a position near the full close position. In consequence, the step between the outer surface of the window glass and the outer surface of the door outer panel is reduced to realize a flush surface state.

In another form of the present invention, the pinion gear is driven through a pair of bevel gears so that the direction of transmission of driving power is changed.

In such a case, the rotor shaft of the power source such as a motor can be disposed to extend in the longitudinal direction of the vehicle, thus enabling an efficient use of the space between the door inner panel and the door outer panel.

In still another form of the present invention, the window glass is moved relative to the pinion towards the door outer panel when the window glass has been moved to a position near the full close position. In consequence, the step between the outer surface of the window glass and the outer surface of the door outer panel is reduced to realize a flush surface state. In this case, the window glass is movable relative to the pinion, so that the pinion is held in meshing engagement with the rack.

DESCRIPTION OF THE PREFERRED EMBODIMENTS

Figure 1:
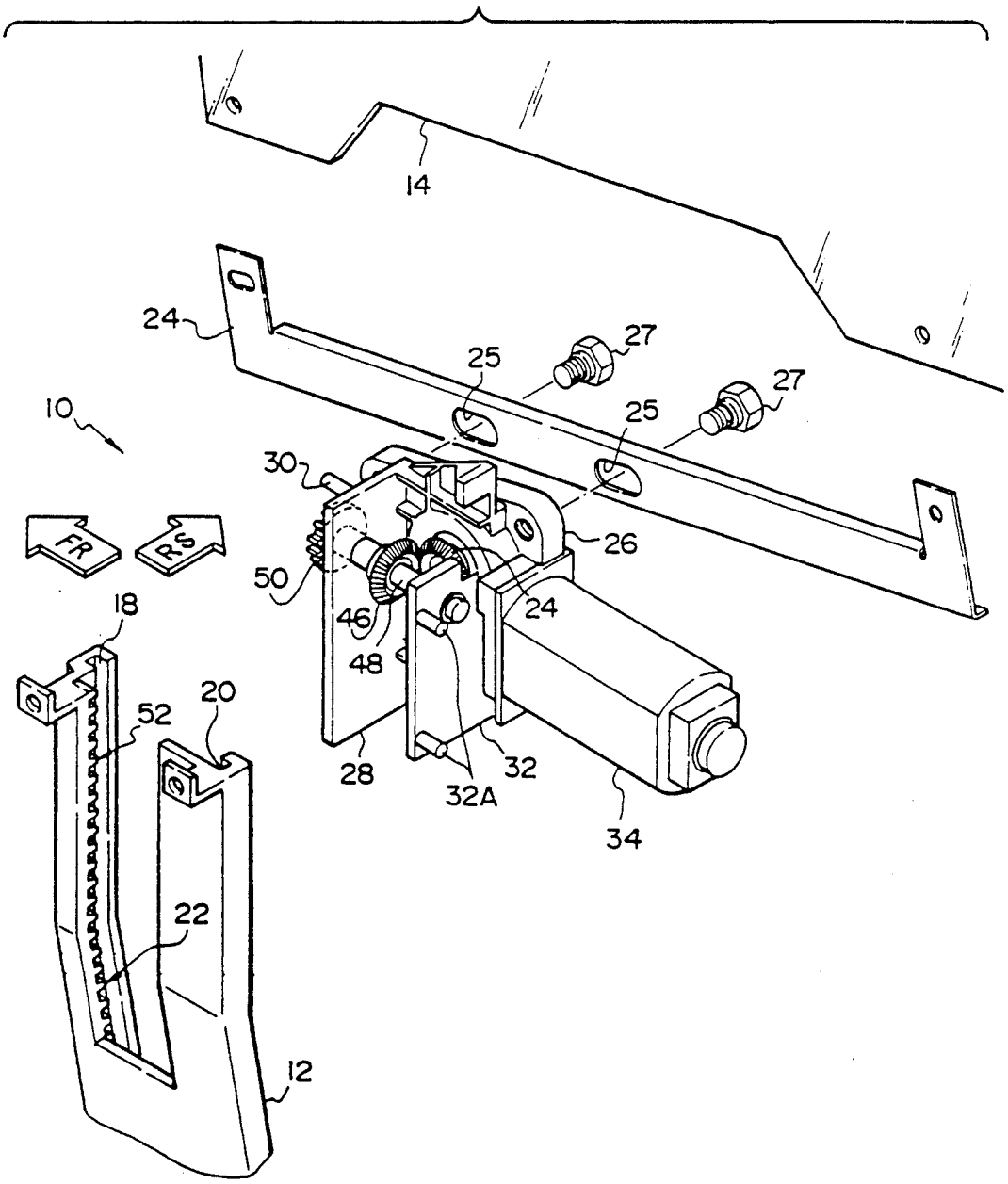
FIG. 1 is a perspective view of an essential portion of a first embodiment of the power window apparatus of the present invention.
Figure 2:
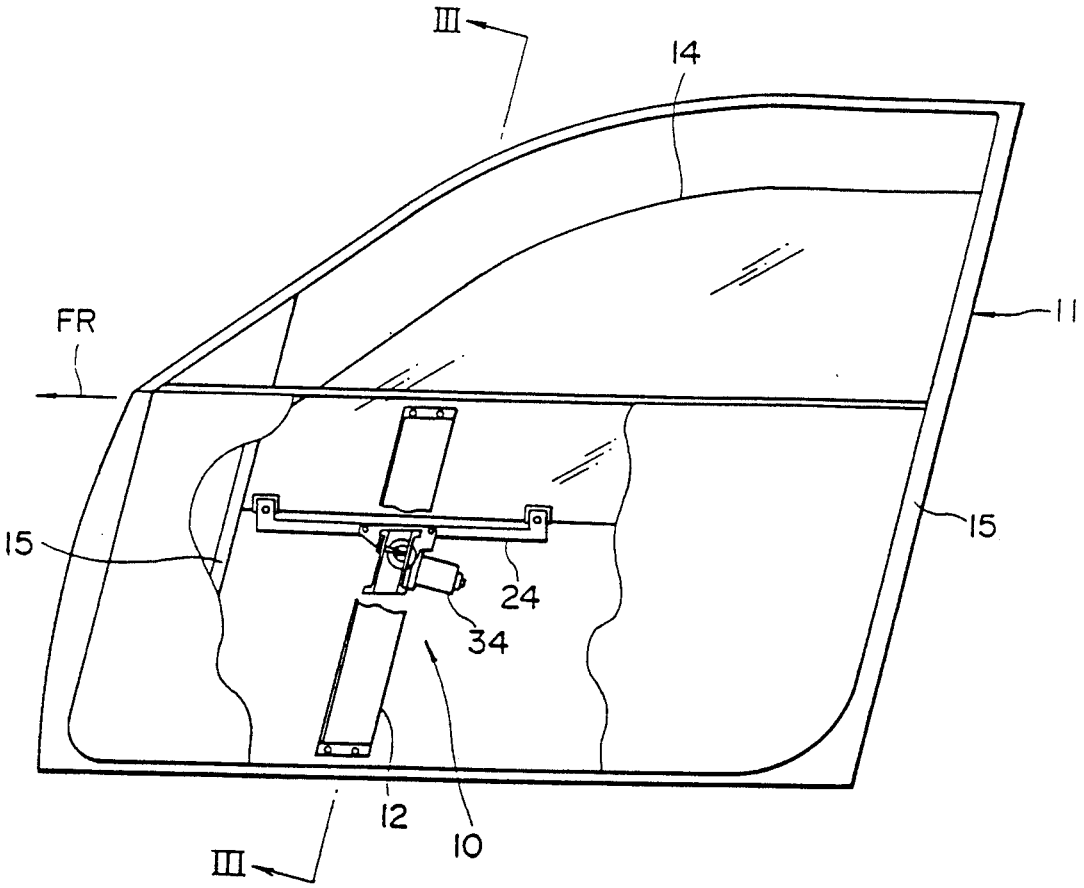
FIG. 2 is a partly-removed front elevational view of the power window apparatus.
Figure 3:
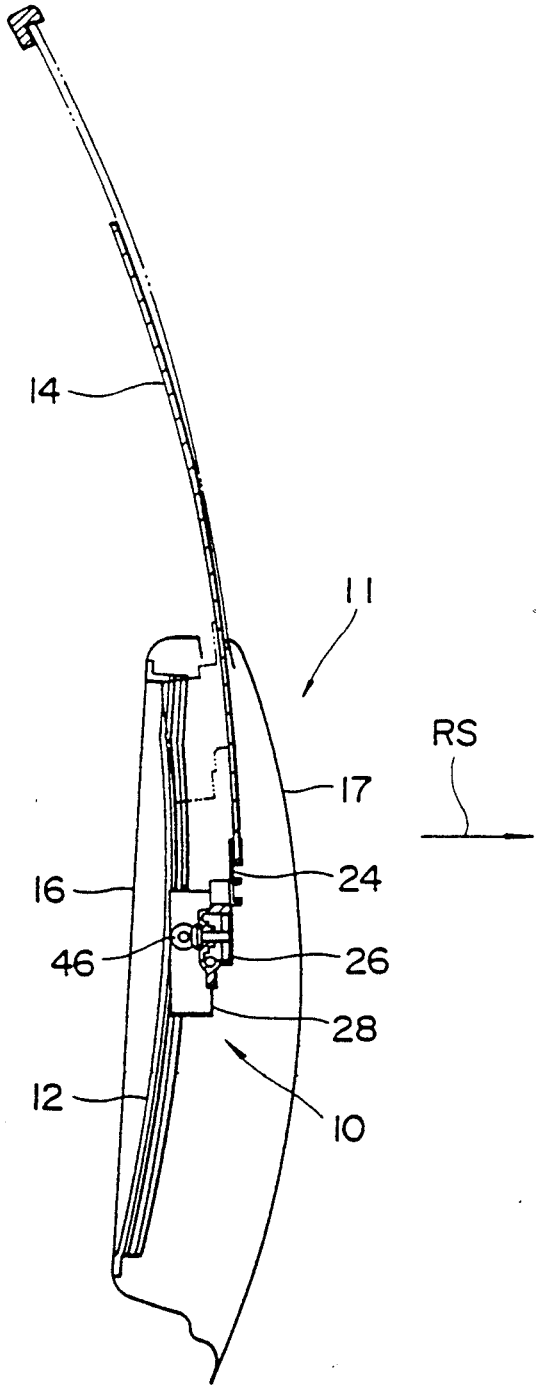
FIG. 3 is a sectional view of a door taken along the line III—III of FIG. 3.

FIG. 1 is a perspective view of an essential portion of a power window apparatus 10 as a first embodiment of the present invention, while FIG. 2 is an elevational view of a right-side door of a vehicle incorporating the power window of the present invention, with a portion of the right-side door being removed. FIG. 3 is a sectional view of the door 11. In these Figures, the arrow FR indicates the forward direction of the vehicle in the state in which the door has been closed, while the arrow RS indicates the right-side direction of the vehicle in the closed state of the door.

The door 11 has a window glass 14 which is slidably held at its front and rear ends as viewed in the direction of running of the vehicle, i.e., at both ends in the breadthwise direction of the door, by a pair of opposing door sashes 15 which extend in vertical direction substantially in parallel with each other. The power window apparatus of the present invention is secured to the lower end of the window glass 14.

Figure 4:
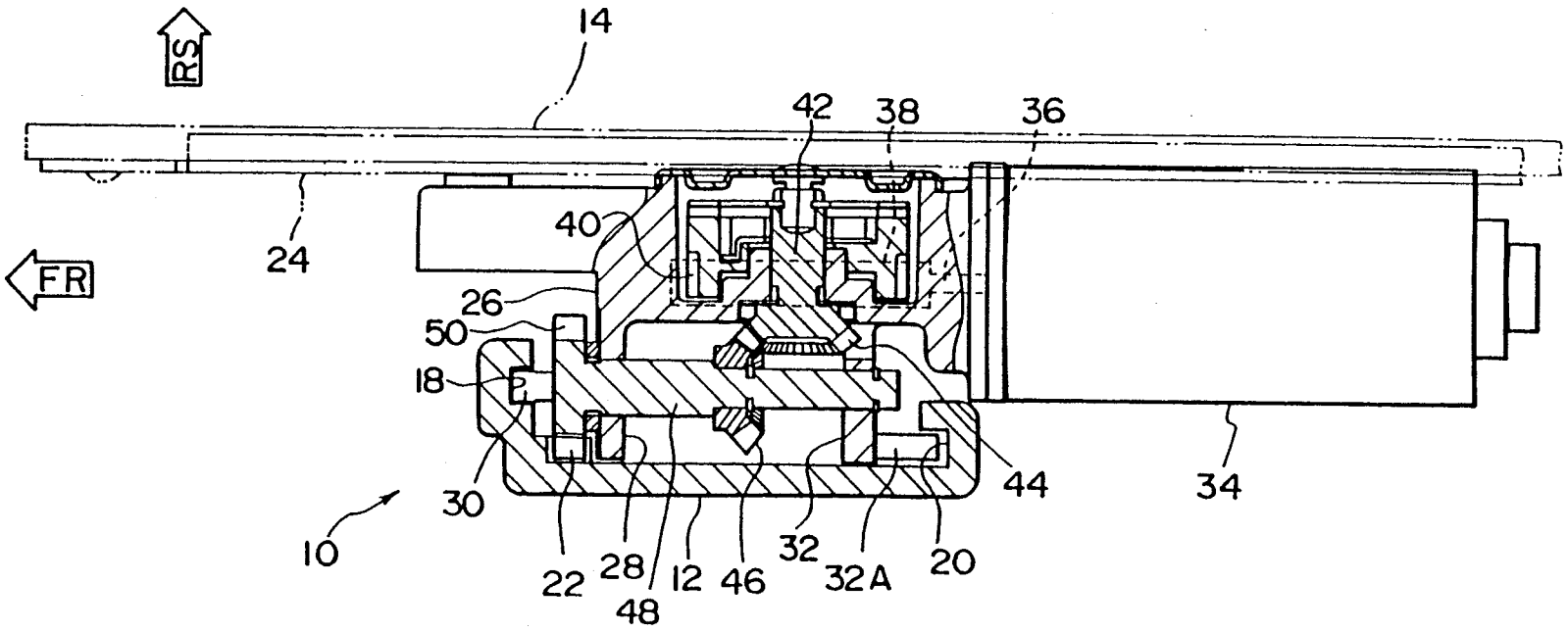
FIG. 4 is a cross-sectional view of an essential portion of the power window apparatus.

The power window apparatus has a guide plate 12 which is fixed to the surface of the door inner panel 16 facing the door outer panel 17 such that its longitudinal axis extends in the direction of movement of the window glass 14 and that the breadthwise direction thereof coincides with the longitudinal axis of the vehicle, i.e. with the breadthwise direction of the door. As will be seen from FIG. 4, the guide plate 12 has a substantially U-shaped cross-section with its both breadthwise ends providing guide portions 18 and 20 which have rectangular horizontal sectional shape. A rack 22 is formed on the portion of the guide plate 12 near one 18 of the guide portions such that the toothed surface of the rack 22 faces the door outer panel 17, i.e., in the direction of the arrow RS.

On the other hand, a holder 24 is secured to the lower end of the window glass 14 as shown in detail in FIG. 2. As will be understood from FIG. 1, the holder has a pair of elongated holes 25. Bolts 27 are extended relatively movably through these elongated holes 25 and are fixed to a gear housing 26. Thus, holder 24 and the gear housing 26 are movable relative to each other in the longitudinal direction of the elongated holes 25.

An arm 28 is formed on one end of the gear housing 26 so as to protect towards the guide plate 12. A rod-like engaging portion 30 orthogonal to the arm 28 is formed on the portion of the gear housing 26 so as to project forwardly of the vehicle, i.e., in the direction of the arrow FR. The arm 28 faces the side wall of the rack 22 formed on the guide plate 12. The engaging portion 30 engages with the guide portion 18 of the guide plate 12 and is slidably received in the guide portion 18. On the other hand, an arm 32 is formed on the portion of the gear housing 26 opposite to the arm 28, so as to project in parallel with the arm 28. The arm 32 is provided with a projection 32A which projects orthogonally therefrom in the direction opposite to the arm 28. The projection 32A engages with the guide portion 20 of the guide plate 12 and is slidably received in the guide portion 20. Thus, the gear housing 26 is movable up and down along the guide plate 12 with their arms 28, 30 and 32 guided by the guide portions 18 and 20 and the side wall of the rack 22.

A motor 34 as a power source is fixed to the rear end of the gear housing 26, i.e., to the end of the gear housing 26 opposite to the arm 28, such that the rotor shaft 36 of the motor 34 is extended in the longitudinal direction of the vehicle, i.e., in the breadthwise direction of the guide plate 12. The rotor shaft 36 projects inwardly of the gear housing 26. A worm gear 38 secured to the end of the rotor shaft 36 meshes with a worm wheel 40 which is rotatably mounted within the gear housing 26.

The worm wheel 40 is carried by a rotor shaft 42 which is disposed between the arms 28 and 32 of the gear housing 26 so as to project from the gear housing 26 towards the guide pate 12 and is provided at its end with a bevel gear 44. The bevel gear 44 meshes with a bevel gear 46.

The bevel gear 46 is secured to an intermediate portion of the pinion shaft 48 which is rotatably supported by the arms 28 and 32 of the gear housing 26. Namely, the pinion shaft 48 is extended orthogonally to the rotary shaft 42 to which the worm wheel 40 and the bevel gear 44 are secured, so that the rotation of the worm wheel is transmitted through 90° turning by the meshing bevel gears 44,46 to the pinion shaft 48 which is extended in parallel with the rotor shaft 36.

A pinion 50 is secured to the front end of the pinion shaft 48 as viewed in the longitudinal direction of the vehicle. The pinion 50 meshes with the rack 22 of the guide plate 12. The arrangement is such that the rotation of the rotor shaft of the motor 34 is transmitted to the pinion 50 through the worm gear 38, worm wheel 40, bevel gear 44 and the bevel gear 46, and the rotation of the pinion 50 which is held in meshing engagement with the stationary rack 22 causes the pinion 50 to roll along the rack 22, so that the gear housing 26 moves up and down together with the window glass 14, motor 34 and other parts, whereby the window glass 14 is moved in the opening and closing directions.

Figure 5:
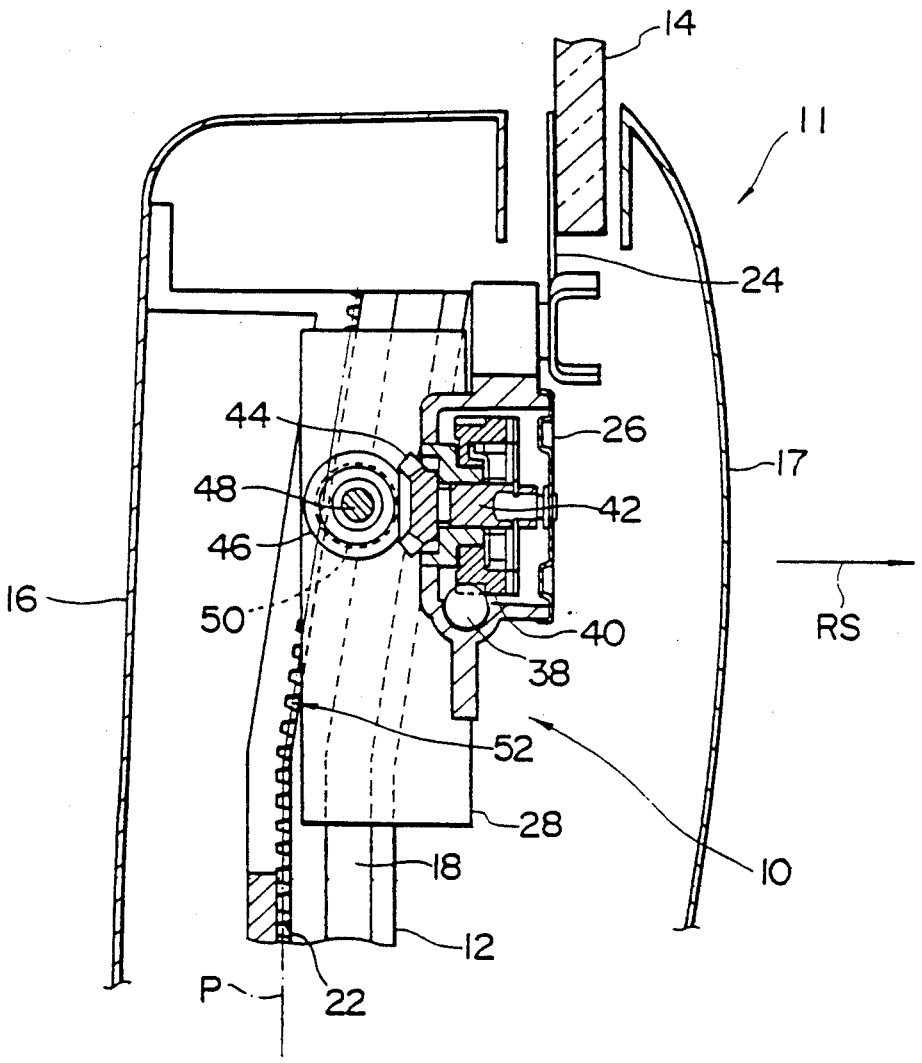
FIG. 5 is a longitudinal sectional view of the power window apparatus.

A shifting means is formed on the upper end of the guide plate 12. More specifically, as shown in FIG. 5, the guide plate 12 is curved at its portion near the upper end outwardly of the vehicle, i.e., towards the door outer panel 17. At the bent portion of the guide plate 12, the pitch line P of the rack also is bent outwardly of the vehicle so as to provide a curved inclined portion 52 presented by an inclined rack. The pitch line of the curved inclined portion 52 is continuous with the pitch line of the rack 22 so that the curved inclined portion 52 serves as a shifting means. The pinion 50 rolling upward along the rack 22 enters the curved inclined portion 52 and further rolls along the curved inclined portion 52 in meshing engagement with the inclined rack so as to be shifted in the breadthwise direction of the vehicle towards the outer side of the vehicle. In consequence, the gear housing 26 which moves together with pinion 50 is moved in the breadthwise direction of the vehicle towards the outer side. The curvature and the size of the curved inclined portion 52 are determined corresponding to the full close position of the window glass 14. The door sash 15 is partly widened so as to allow the movement of the gear housing 26 and, hence, the movement of the window glass 14 in the outward breadthwise direction of the vehicle.

The operation of this embodiment is as follows.

When the motor 34 of the power window apparatus 10 is started, the rotation of the rotor shift of the motor 34 is transmitted to the pinion 50 through the worm gear 38, worm wheel 40 and bevel gears 44 and 46, so that the pinion 50 rotates. As a result, the pinion rolls along the rack 22 so that the gear housing 26 carrying the pinion 50 is moved up and down together with the window glass 14 along the guide plate 12, whereby the window glass is moved in the opening and closing directions.

The transmission of the rotation of the worm wheel 40 to the pinion 50 is made through a 903 turning of the direction by virtue of the meshing bevel gears 44, 46 so that the rotor shaft 36 of the pinion 48 can be arranged in parallel with each other. This enables the axis of the rotor shift 36, i.e., the longitudinal axis of the motor 34, to be arranged in the longitudinal direction of the vehicle, i.e., in the breadthwise direction of the door, thus enabling an economical use of the internal space of the door between both door panels.

When the pinion 50 has rolled along the rack to bring the window glass 14 to a region near the full close position, the pinion 50 enters the curved inclined portion 52. Since the curved inclined portion 52 is curved and inclined outward in the breadthwise direction of the vehicle, the pinion 50 meshing with and rolling along the curved inclined portion is made to move outward in the breadthwise direction of the vehicle. In consequence, the gear housing 26 which moves together with the pinion 50 is forcibly moved outward in the breadthwise direction of the vehicle, with the result that the window glass 14 to which the gear housing 26 is fixed is also moved outward in the breadthwise direction of the vehicle, i.e., towards the door outer panel 17. In consequence, the step between the outer surface of the window glass 14 and the outer surface of the door outer panel 17 is reduced to realize a flush surface state.

A second embodiment of the present invention will be described with reference to FIGS. 6 to 9. In these Figures, the same reference numerals are used to denote parts which are basically the same as those in the first embodiment, and a detailed description of such parts is omitted.

Figure 6:
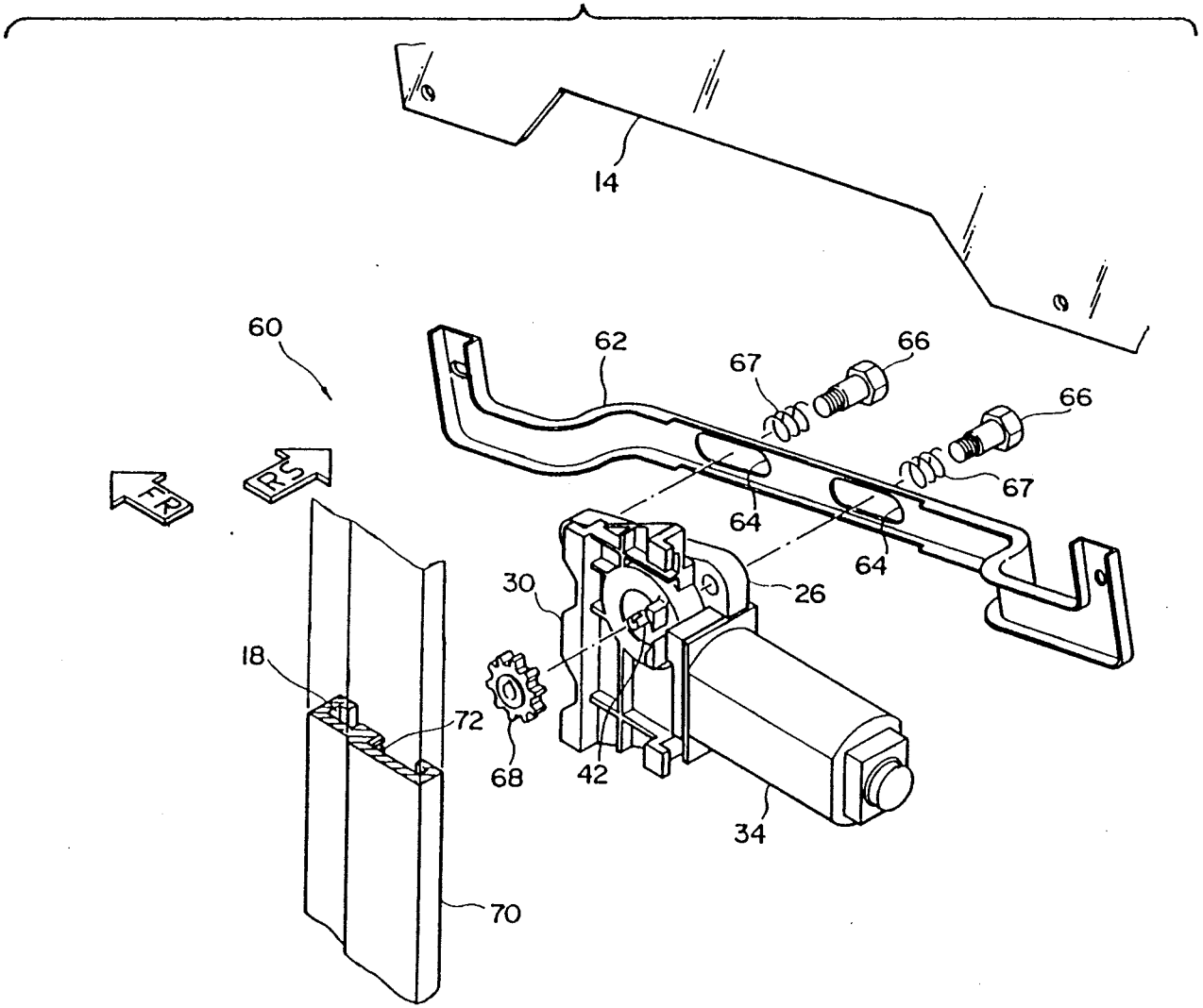
FIG. 6 is a perspective view of an essential portion of a second embodiment of the power window apparatus of the present invention.
Figure 7:
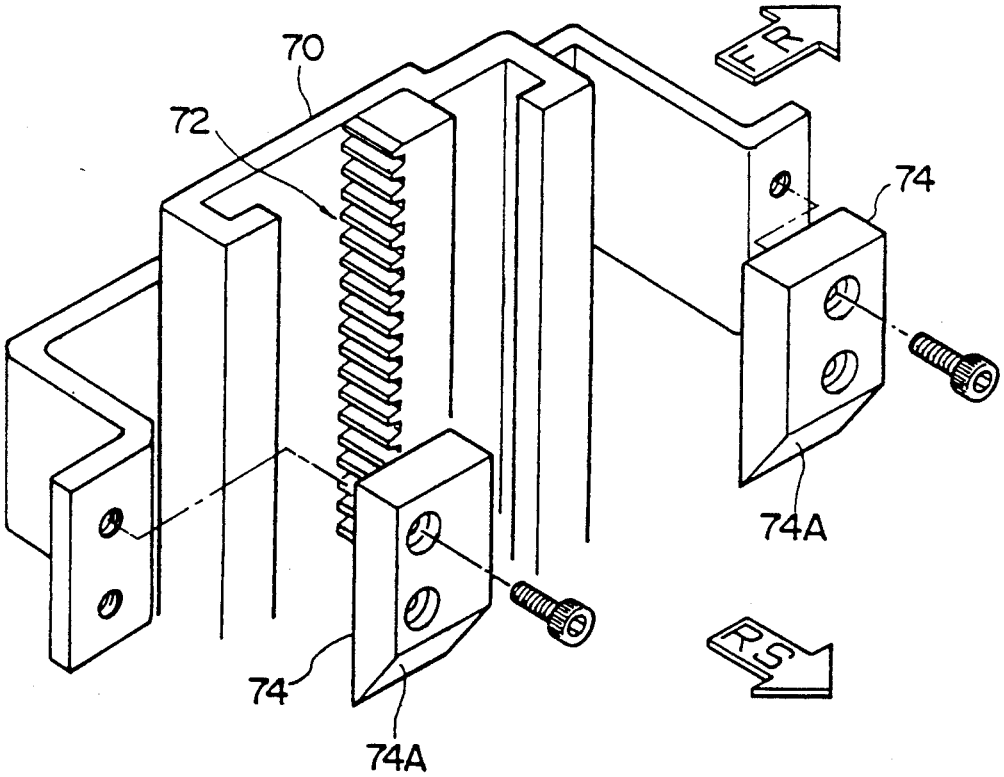
FIG. 7 is a perspective view of a projection.
Figure 8:
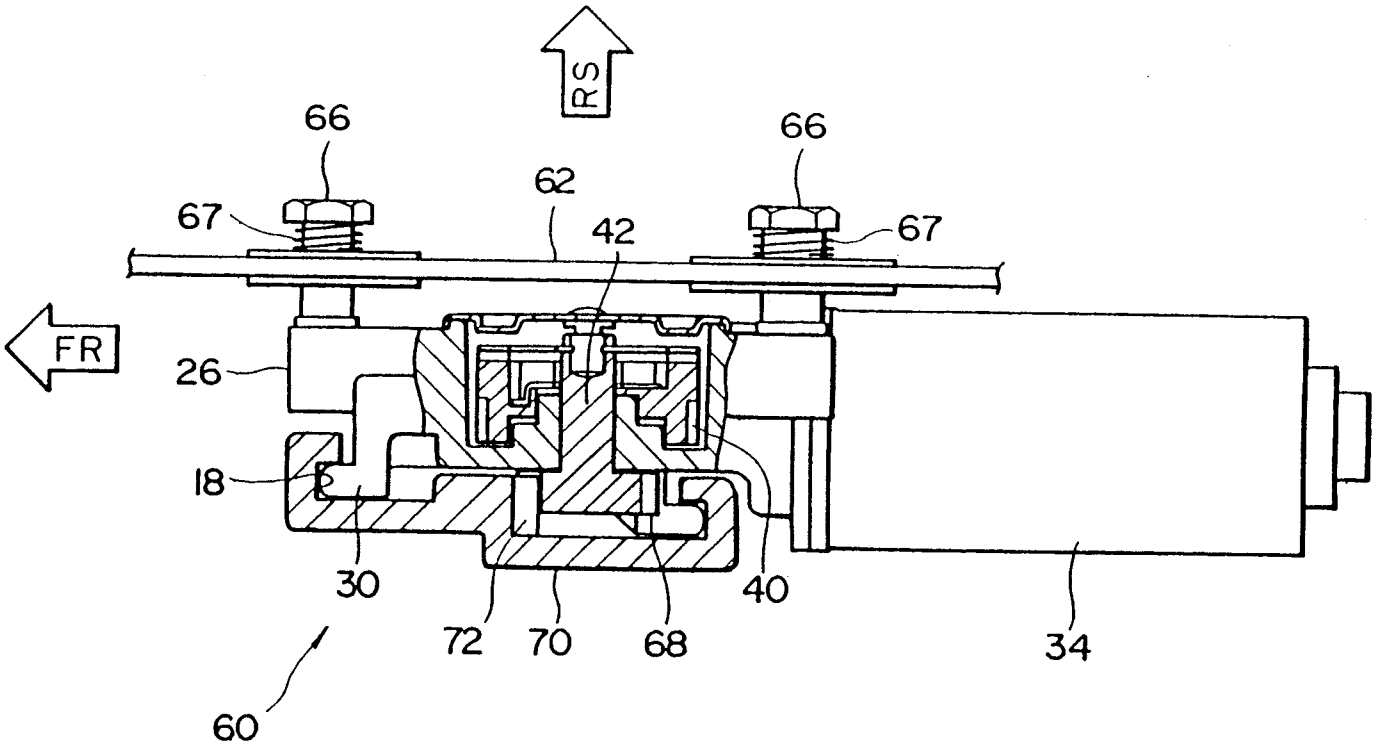
FIGS. 8 and 9 are cross-sectional views of the second embodiment in different states of operation.
Figure 9:
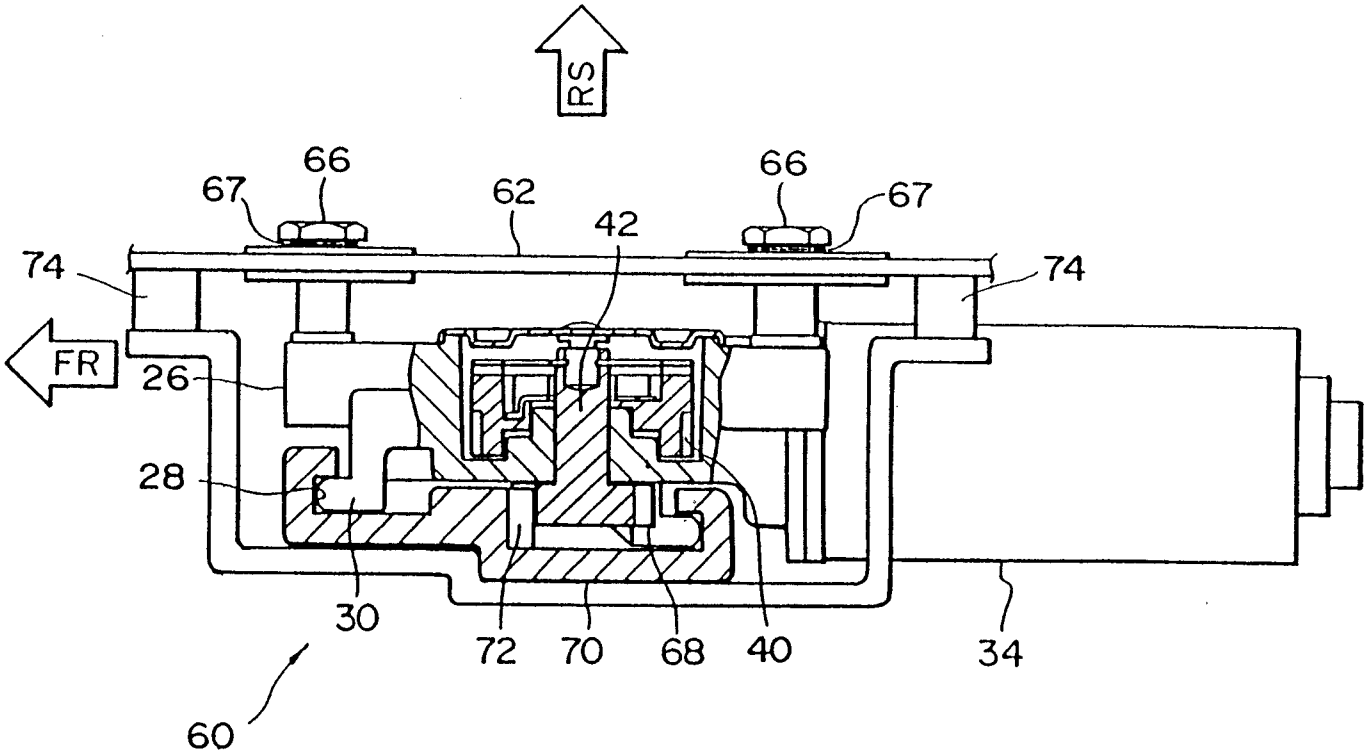

FIGS. 6 and 7 are perspective views of critical portions of the second embodiment of the power window apparatus 60 in accordance with the present invention, while FIGS. 8 and 9 show these critical portions in sectional views.

The power window apparatus 60 has a holder 62 fixed to the lower end of a window glass 14, and a gear housing 26 secured to the holder 62. The holder 62 is provided with a pair of elongated holes 64 which relatively movably receive bolts 66 fixed to the gear housing 26.

Coiled compression springs 67 are loaded between the holder 62 and the bolts 66 so as to produce urging force for urging the holder 62 and the bolts 66 towards each other. In consequence, the lower end of the window glass 14 is urged towards the inside of the compartment.

Thus, the holder 62 is movable relative to the gear housing 26 both in the direction of the longitudinal axes of the elongated holes 64 and the direction of the axes of the bolts 66.

A pinion gear 68 is directly secured to the end of the rotary shaft 42 of the worm wheel 40 disposed in the gear housing 26, in place of the bevel gear 44 used in the first embodiment. In consequence, the pinion 68 and the worm wheel 40 rotate as a unit with each other. Thus, the rotation axis of the pinion 68 extends in the breadthwise direction of the vehicle.

The pinion 68 meshes with a rack 72 which is formed on a breadthwise end surface of the guide plate 70. In this case, the rack 72 is formed on the surface of the guide plate 70 which faces the rear end of the vehicle.

As shown in detail in FIG. 7, a pair of projection plates 74 serving as shifting members are secured to a portion of the guide plate 70 near the upper end thereof, i.e., to a portion where the lower end of the window glass 14 is positioned when the window glass has been moved almost to the full close position. The projection plates 74 are directed outward in the breadthwise direction of the vehicle, i.e., towards the door outer panel 17. The projection plate 74 is engageable with a holder 62 fixed to the window glass 14. Namely, when the pinion gear 68 rolling along the rack 72 reaches the projection plates 74, the holder 62 is brought into engagement with tapered cam surfaces 74A of the projection plates 74 so that the holder 62 is urged by the cam action of the tapered surfaces 74A outward in the breadthwise direction of the vehicle as a result of further rotation of the pinion 68. The positions and the dimensions of the projection plates 74 are determined in accordance with the full close position of the window glass 14.

The operation of this embodiment is as follows.

When the motor 34 of the power window apparatus 60 is started, the torque of the motor is transmitted to the pinion 68 through the worm gear 38 and the worm wheel 40 so as to cause the pinion 68 to rotate and roll along the rack 72, whereby the gear housing 26 moves along the guide plate 70, whereby the window glass 14 to which the gear housing 26 is secured is moved up and down.

In this state, the holder 62 is pressed by the urging force of the coiled compression spring 67, so that the window glass 14 is urged towards the gear housing 26 thereby eliminating any play.

When the window glass reaches a position near the full close position as a result of further rotation of the pinion 68, the pinion gear 68 rolls along the rack 72 to bring the holder 62 to a position near the projection plates 74. Further rotation of the pinion 68 causes the holder 62 to engage with the cam surfaces of the projection plates 74 which are oriented in the outward breadthwise direction of the vehicle, so that the holder 62 is progressively biased outward in the breadthwise direction of the vehicle against the force of the compression spring 67. In consequence to window glass 14 fixed to the holder 62 is also urged outwardly in the breadthwise direction of the vehicle, i.e., towards the door outer panel 17, as shown in FIG. 9. For driving the window glass 14 in the opening direction from the full close position, the pinion 68 is reversed so that the holder 62 is progressively lowered. Since the holder 62 is urged by the spring 67 into contact with the projection plate 74, the holder 62 slides down along the tapered cam surface of the projection plate 74, whereby the lower end of the window glass 14 is shifted inwardly of the compartment of the vehicle.

In consequence, the step between the outer surface of the window glass 14 and the outer surface of the door outer panel 17 is reduced when the window glass 14 is in the full close position, thus realizing flush surface state.

The window glass 14 and the holder 62 are movable relative to the gear housing 26 and, hence, to the pinion 68. Thus, the shifting of the lower end of the window glass in the breadthwise direction of the vehicle can be conducted without impairing the condition of meshing between the pinion 68 and the rack 72, so that the window glass 14 is allowed to move smoothly up and down.

In the embodiments described hereinbefore, only the lower end portion of the window glass is shifted outward in the breadthwise direction of the vehicle. This, however, is only illustrative and the arrangement may be such that only the upper end portion of the window glass 14 or the whole of the window glass is shifted outward in the breadthwise direction of the vehicle so as to reduce the step between the outer surface of the window glass 14 and the outer surface of the door outer panel thereby realizing flush surface state.

What is claimed is:

1. A power window apparatus disposed in a space between a door inner panel and a door outer panel of a door for moving a window glass between an open and a close position, comprising:

driving means secured to said window glass and having a rotary shaft;

a rack stationarily disposed so as to extend in the opening and closing direction of said window glass;

a pinion drivingly connected to said rotary shaft for rotating in meshing engagement with said rack;

guide means for guiding said pinion gear along said rack while maintaining the meshing engagement between said pinion and said rack; and shifting means for shifting at least the lower end portion of said window glass toward said door outer panel when said window glass has been moved to a position near the fully closed position and including an inclined rack provided at an upper end portion of said rack, said inclined rack having a pitch line continuous from the pitch line of said rack and inclined towards said door outer panel.

2. A power window apparatus according to claim 1, wherein said shifting means is capable of guiding said lower end portion of said window glass towards said door outer panel thereby shifting said lower end portion of said window glass towards said door outer panel.

3. A power window apparatus according to claim 1, wherein said pinion is drivingly connected to said rotary shaft through a pair of meshing bevel gears.

4. A power window apparatus according to claim 1, wherein said driving means is secured to a portion of said window glass near the lower end thereof such that the axis of said rotary shaft extends in the breadthwise direction of the door.

5. A power window apparatus disposed in a space between a door inner panel and a door outer panel of a door and capable of moving a window glass so as to open and close the window of said door, comprising:

a motor having a rotary shaft and secured to said window glass such that the axis of said rotary shaft extends in the breadthwise direction of said window glass;

a rack stationarily disposed such that the toothed surface thereof is directed towards said door outer panel, said rack having a toothed portion for causing said window glass to move in the opening and closing directions and a toothed portion for causing said window glass to be shifted towards said door outer panel when said window glass has been moved to a position near the full close position;

a pinion drivingly connected through a gear train to said rotary shaft and capable of rotating in meshing engagement with said rack; and guide mean capable of guiding said pinion gear along said rack while maintaining the meshing engagement between said pinion and said rack.

6. A power window apparatus according to claim 5, wherein said gear train includes:

a worm gear fixed to said rotary shaft;

a worm wheel rotatable in meshing engagement with said worm gear;

a first bevel gear fixed to the shaft of said worm wheel for rotation together with said worm wheel; and a second bevel gear capable of rotating in meshing engagement with said first bevel gear and fixed to the shaft of said pinion for rotation together with said pinion.

7. A power window apparatus according to claim 6, wherein said rotary shaft and said shaft of said pinion are disposed so as to extend in the breadthwise direction of said window glass.

8. A power window apparatus disposed in a space between a door inner panel and a door outer panel of a door and capable of moving a window glass so as to open and close the window of said door, comprising:

a motor having a rotary shaft secured to said window glass in such a manner that said motor is movable relative to said window glass in the thicknesswise direction of said window glass and such that the axis of said rotary shaft extends in the breadthwise direction of said window glass;

a rack stationarily disposed with its toothed surface directed in a breadthwise direction of said door and extending in the opening and closing directions of said window glass;

a pinion connected to said rotary shaft through a gear train and capable of rotating in meshing engagement with said rack;

a guide means capable of guiding said pinon along said rack while maintaining said pinion in meshing engagement with said rack; and urging means for urging lower end portion of said window glass towards said door outer panel when said window glass has been moved to a position near the full close position.

9. A power window apparatus according to claim 8, wherein said gear train includes:

a worm gear fixed to said rotary shaft; and a worm wheel rotatable in meshing engagement with said worm gear and fixed to the shaft of said pinion for rotation together with said pinion.

10. A power window apparatus according to claim 8, wherein said urging means includes a projecting member fixed to a portion of said guide means near the upper end thereof and projecting towards said door outer panel so as to urge the lower end portion of said window glass.

11. A power window apparatus according to claim 8, wherein said motor is supported by supporting means through bolts from the outer side of said window glass, and wherein compression spring is loaded between the head of said bolt and the outer surface of said supporting means, whereby said motor is movable relative to said window glass.

12. A power window apparatus disposed in a space between a door inner panel and a door outer panel of a door for moving a window glass between an open and a closed position, comprising:

driving means secured to said window glass and having a rotary shaft;

a rack stationarily disposed so as to extend in the opening and closing direction of said window glass;

a pinion drivingly connected to said rotary shaft for rotating in meshing engagement with said rack;

guide means for guiding said pinion gear along said rack while maintaining the meshing engagement between said pinion and said rack; and shifting means for shifting at least the lower end portion of said window glass towards said door outer panel when said window glass has been moved to a position near the fully closed position and including a projection member fixed to a portion of said guide means near the upper end thereof and projecting towards said door outer panel.

13. A power window apparatus according to claim 12, wherein said shifting means is capable of urging said lower end portion of said window glass towards said door outer panel thereby shifting said lower end portion of said window glass towards said door outer panel.

* * * * *